US006866465B2

(12) United States Patent
Jester et al.

(10) Patent No.: US 6,866,465 B2
(45) Date of Patent: Mar. 15, 2005

(54) ROBOTIC SYSTEM AND METHOD FOR COLLECTING AND DISPENSING REGULAR AND IRREGULAR SHAPED OBJECTS

(76) Inventors: John M. Jester, 11 Buccaneer Way, Coronado, CA (US) 92118; George Jemmott, 269 Solar View Dr., San Marcos, CA (US) 92069

( * ) Notice: Subject to any disclaimer, the term of this patent is extended or adjusted under 35 U.S.C. 154(b) by 103 days.

(21) Appl. No.: 10/231,819

(22) Filed: Aug. 28, 2002

(65) Prior Publication Data

US 2004/0042884 A1 Mar. 4, 2004

(51) Int. Cl.[7] ..... B60P 1/00

(52) U.S. Cl. ..... 414/556; 414/421; 414/472; 414/487; 414/501; 414/519; 414/525.1; 414/696; 414/722; 901/1

(58) Field of Search ..... 414/404, 421, 414/472, 487, 501, 519, 520, 525.1, 551, 553, 554, 555, 556, 24.5, 696, 721, 722, 724, 687; 901/1

(56) References Cited

U.S. PATENT DOCUMENTS

| | | | | | |
|---|---|---|---|---|---|
| 1,389,421 | A | * | 8/1921 | Corrigan | 414/687 |
| 2,405,755 | A | * | 8/1946 | Rodefeld | 414/554 |
| 2,635,884 | A | * | 4/1953 | Christiansen | 239/651 |
| 2,979,215 | A | * | 4/1961 | Brisson | 414/553 |
| 3,353,696 | A | * | 11/1967 | Goodman | 414/487 |
| 3,520,432 | A | * | 7/1970 | Henriksson et al. | 414/487 |
| 4,064,967 | A | * | 12/1977 | Doolittle | 180/435 |
| 4,103,794 | A | * | 8/1978 | Shaw | 414/501 |
| 4,113,120 | A | * | 9/1978 | Pickrell | 414/350 |
| 4,290,820 | A | * | 9/1981 | Swisher et al. | 134/6 |
| 4,578,008 | A | * | 3/1986 | Gleason | 414/24.5 |
| 5,507,612 | A | * | 4/1996 | Siebenga | 414/111 |
| 5,647,554 | A | * | 7/1997 | Ikegami et al. | 242/390.9 |
| 5,934,858 | A | * | 8/1999 | Christenson | 414/408 |
| 6,283,220 | B1 | * | 9/2001 | Carter | 169/24 |
| 6,584,376 | B1 | * | 6/2003 | Van Kommer | 700/245 |
| 6,674,259 | B1 | * | 1/2004 | Norman et al. | 318/568.11 |

FOREIGN PATENT DOCUMENTS

| | | | |
|---|---|---|---|
| JP | 665949 | * | 3/1994 |

* cited by examiner

*Primary Examiner*—Eileen D. Lillis
*Assistant Examiner*—M. Scott Lowe
(74) *Attorney, Agent, or Firm*—Michael H. Jester

(57) ABSTRACT

Wheels, endless treads, or articulating legs powered by a first drive mechanism support a chassis for movement along a support surface over which are spread one or more regular or irregular shaped objects. A transversely extending, forwardly opening receptacle is mounted to the chassis for receiving and holding the objects. The receptacle is movable by a second drive mechanism about a substantially horizontal axis between a lowered collecting position and a raised dumping position for dispensing collected objects into a collection bin. Working together a pair of sweeper gates mounted at opposite ends of the receptacle can be rotated by a third drive mechanism about respective vertical axes between fully open and fully closed positions. The sweeper gates entrap and pull objects into the receptacle when they are within a predetermined proximity of the receptacle. A remote control allows an operator to control the first, second and third drive mechanisms.

10 Claims, 3 Drawing Sheets

ROBOTIC SYSTEM AND METHOD FOR COLLECTING AND DISPENSING REGULAR AND IRREGULAR SHAPED OBJECTS

FIELD OF THE INVENTION

The present invention relates to robots that can remotely pick up and deliver objects.

BACKGROUND OF THE INVENTION

There are many situations where it would be desirable to remotely collect one or more regular or irregular shaped objects spread out over the floor, ground or other substantially level surface for deposit into a collection bin for later re-use or study. This is the case where the environment in which the objects are located is inhospitable to human presence. An example is a golf driving range where hundreds of golf balls need to be collected without suspending play. The environment may also be so distant that it would be too dangerous or time consuming for humans to travel there. An example is the surface of a planet, such as Mars, where a rover is best suited for collecting rocks and other geologic specimens.

In the past, various grippers and scoopers have been attached to the distal end of an articulating or extensible arm mounted to a wheeled or endless treaded vehicle. Depending upon the shape of the objects to be collected, these devices have in many cases been tedious to operate by remote control in a manner that permits the objects to be quickly and reliably collected. Extended operations can unnecessarily drain battery power and sometimes valuable objects must be left behind. Furthermore, the complexity of such devices makes them prone to breakdowns.

Prior art robots have often had limited storage capabilities and therefore it would also be desirable for a robotic collection system to be able to rapidly and efficiently dispense or dump the collected objects into a storage compartment or other collection bin. For example, a Mars rover would preferably have the capability of rapidly and efficiently collecting various rock samples, dumping them into a collection bin, and then continuing the process of collection. The collection bin could be part of a rocket module that would return the collected Mars rock samples to Earth for scientific study.

SUMMARY OF THE INVENTION

It is the primary object of the present invention to provide an improved robotic system for rapidly and reliably collecting one or more regular and irregular shaped objects spread over the floor, ground or other support surface.

It is another object to provide such a robotic system that will rapidly and reliably dispense the collected objects into a collection bin.

It is still another object to provide an improved robotic method for rapidly and reliably collecting one or more regular and irregular shaped objects spread over the floor, ground or other support surface.

It is yet another object of the present invention to provide an improved robotic method for rapidly and reliably dispensing the collected objects into a collection bin.

In accordance with our invention a robotic system is provided for collecting and dispensing regular and irregular shaped objects. Wheels, endless treads or articulating legs are powered by a first drive mechanism and support a chassis for movement along a support surface over which are spread one or more regular or irregular shaped objects. A transversely extending, forwardly opening receptacle is mounted to the chassis for receiving and holding the objects. The receptacle is movable by a second drive mechanism about a substantially horizontal axis between a lowered collecting position and a raised dumping position for dispensing collected objects into a collection bin. A pair of sweeper gates are each pivotally mounted at a corresponding end of the receptacle for pivotal motion about a corresponding vertical axis when the receptacle is in its lowered collecting position. Working together the pair of sweeper gates can be rotated by a third drive mechanism between fully open and fully closed positions to entrap and pull objects into the receptacle when they are within a predetermined proximity of the receptacle. A remote control allows an operator to control the first, second and third drive mechanisms.

In accordance with our invention a robotic method is provided for collecting and dispensing regular and irregular shaped objects. The first step of our method involves approaching one or more regular and irregular shaped objects spread over a support surface with a forwardly opening receptacle in a lowered collecting position. The next step of our method involves rotating a pair of sweeper gates mounted on opposite ends of the receptacle to entrap the objects and pull them into the receptacle when the objects are within a predetermined proximity of the receptacle. The next step of our method involves returning the receptacle to a collection bin. The final step of our method involves elevating the receptacle to a raised dumping position to dispense the collected objects into the collection bin.

DESCRIPTION OF THE PREFERRED EMBODIMENTS

Figure 1A:
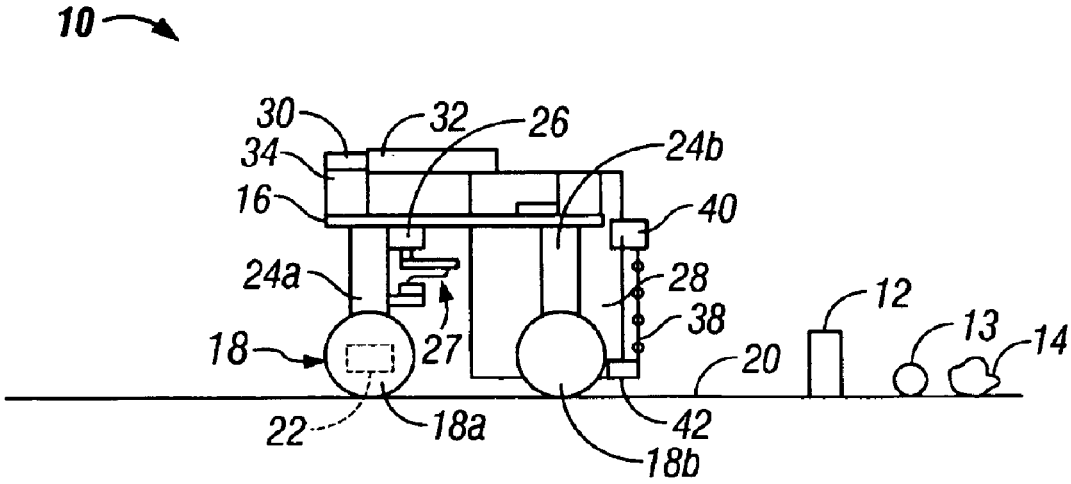
FIG. 1A is a simplified side elevation view of a preferred embodiment of our robotic system illustrating the lowered collecting position of its receptacle.
Figure 1B:
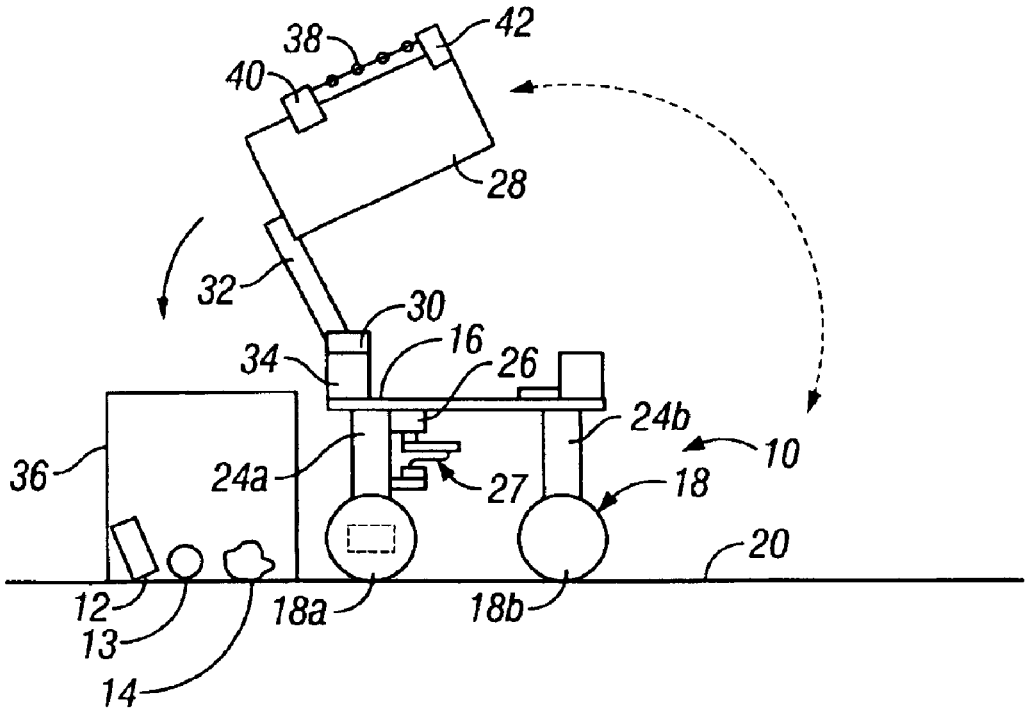
FIG. 1B is a simplified side elevation view of the preferred embodiment of our robotic system illustrating the raised dumping positions of its receptacle.

Referring to FIGS. 1A and 1B, in accordance with our invention a robotic system is provided for collecting and dispensing one or more regular shaped objects such as cylinder 12 and sphere 13, and irregular shaped objects such as rock 14. The robotic system includes a vehicle 10 having a chassis 16 and four wheels 18 that support the chassis 16 for movement along a substantially level support surface 20 over which the objects 12, 13 and 14 are spread. Besides the wheels 18, other transport means may support the chassis 16 such as articulating legs or endless treads (not illustrated). The rearward wheels 18*a* are powered by a first drive mechanism preferably in the form of separate electric motor and gear reduction assemblies 22 associated with each rearward wheel 18*a*. The rearward wheels 18*a* are mounted to the lower ends of pivot legs 24*a* whose upper ends are rotatably mounted to the chassis 16 for twisting motion to steer the chassis 16 as it traverses the support surface 20. A drive mechanism in the form of a servomechanism 26 is provided for twisting the rear wheels 18*a* through a tie bar linkage 27. The forward wheels 18*b* are mounted on shafts that are mounted to the lower ends of fixed legs 24*b* whose upper ends are fixedly mounted to the chassis 16. Where the vehicle 10 employs endless treads instead of the wheels 18, the vehicle 10 is steered by differential forward and rearward motion of the treads, as is well known.

Figure 3:
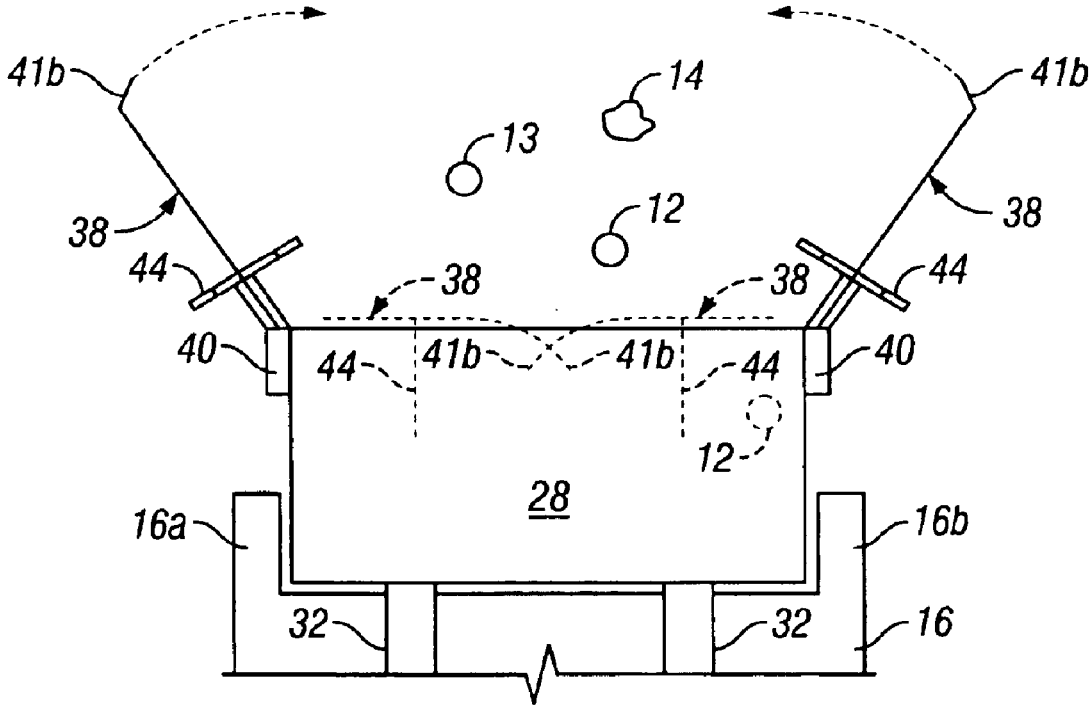
FIG. 3 is an enlarged top plan view of the receptacle of the system of FIGS. 1A and 1B illustrating the fully open and fully closed positions of its sweeper gates in solid and phantom lines, respectively.

Referring still to FIGS. 1A and 1B, a transversely extending, forwardly opening bucket or receptacle 28 is mounted in the front of the chassis 16 for receiving and holding the objects 12, 13 and 14. The chassis 16 has a generally U-shaped configuration which allows the receptacle to fit within a recess between a pair of forward leg portions 16*a* and 16*b* of the chassis as best seen in FIG. 3. Precise positioning of the receptacle 28 relative to the objects 12, 13 and 14 is achieved by mounting the receptacle 28 on the forward end of the chassis 16 and steering the chassis 16 from the rear with the steerable rearward wheels 18*a*. The receptacle 28 is movable about a substantially horizontal axis by another drive mechanism in the form of a plurality of servomechanisms 30, only one of which is visible in FIGS. 1A and 1B. The receptacle 28 is rigidly mounted to the outer ends of a pair of elongate lifting arms 32. The inner ends of the lifting arms are rigidly attached to the output shafts (not visible) of corresponding ones of the servomechanisms 30 which are supported on blocks 34 mounted on the rear of the chassis 16. The receptacle 28 can be moved between a lowered collecting position and a raised dumping position for dispensing collected objects 12, 13 and 14 into a collection bin 36. The lowered collecting and raised dumping positions of the receptacle 28 are illustrated in FIGS. 1A and 1B, respectively.

Figure 2:
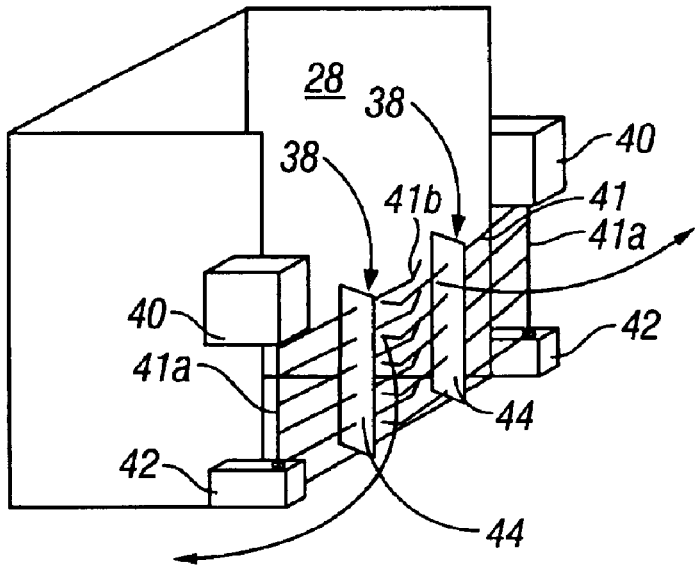
FIG. 2 is an enlarged perspective view of the receptacle of the system of FIGS. 1A and 1B illustrating details of its sweeper gates.

Referring to FIG. 2, a pair of sweeper gates 38 have inner ends that are each pivotally mounted at a corresponding end of the receptacle 28 for pivotal motion about a corresponding vertical axis when the receptacle 28 is in its lowered collecting position. Working together the pair of sweeper gates 38 can be rotated by another drive mechanism in the form of a pair of servomechanisms 40. The sweeper gates 38 extend vertically to create barriers for entrapping the objects 12, 13 and 14. Preferably the sweeper gates 28 have a lightweight grid construction comprising a plurality of orthogonally intersecting thin metal rods 41 of that are welded or otherwise affixed together. The lower ends of the innermost vertical inner rods 41*a* of the sweeper gates 38 are supported by pivot bearing blocks 42. The upper ends of the innermost vertical inner rods 41*a* of the sweeper gates 38 are coupled to the output shafts of the servomechanisms 40.

The sweeper gates 38 pivot between fully open and fully closed positions illustrated in FIG. 3 in solid lines and phantom lines, respectively. When the sweeper gates 38 are in their closed positions their outer ends criss-cross and form a barrier that effectively closes off the forward opening of the receptacle 28 for entrapping the objects 12, 13 and 14. The closing motion of the sweeper gates 38 can be used to entrap and pull the objects 12, 13 and 14 into the receptacle 28 when they are within a predetermined proximity of the receptacle 28. Entrapment of the objects 12, 13 and 14 and pulling of the same into the receptacle 28 is further enhanced by fabricating the sweeper gates 38 with a dog-legged cross-section. The outer ends 41*b* of the horizontal rods of the sweeper gates 38 are interleaved when the sweeper gates 38 are in their closed positions. A pair of planar baffles 44 vertically span the rods 41 of corresponding ones of the sweeper gates 38 roughly intermediate their lengths. The baffles 44 help to segregate and hold different types of objects in compartments of the receptacle 28 so that they are not lost during subsequent openings and closings of the sweeper gates 38 to collect additional objects.

Figure 4:
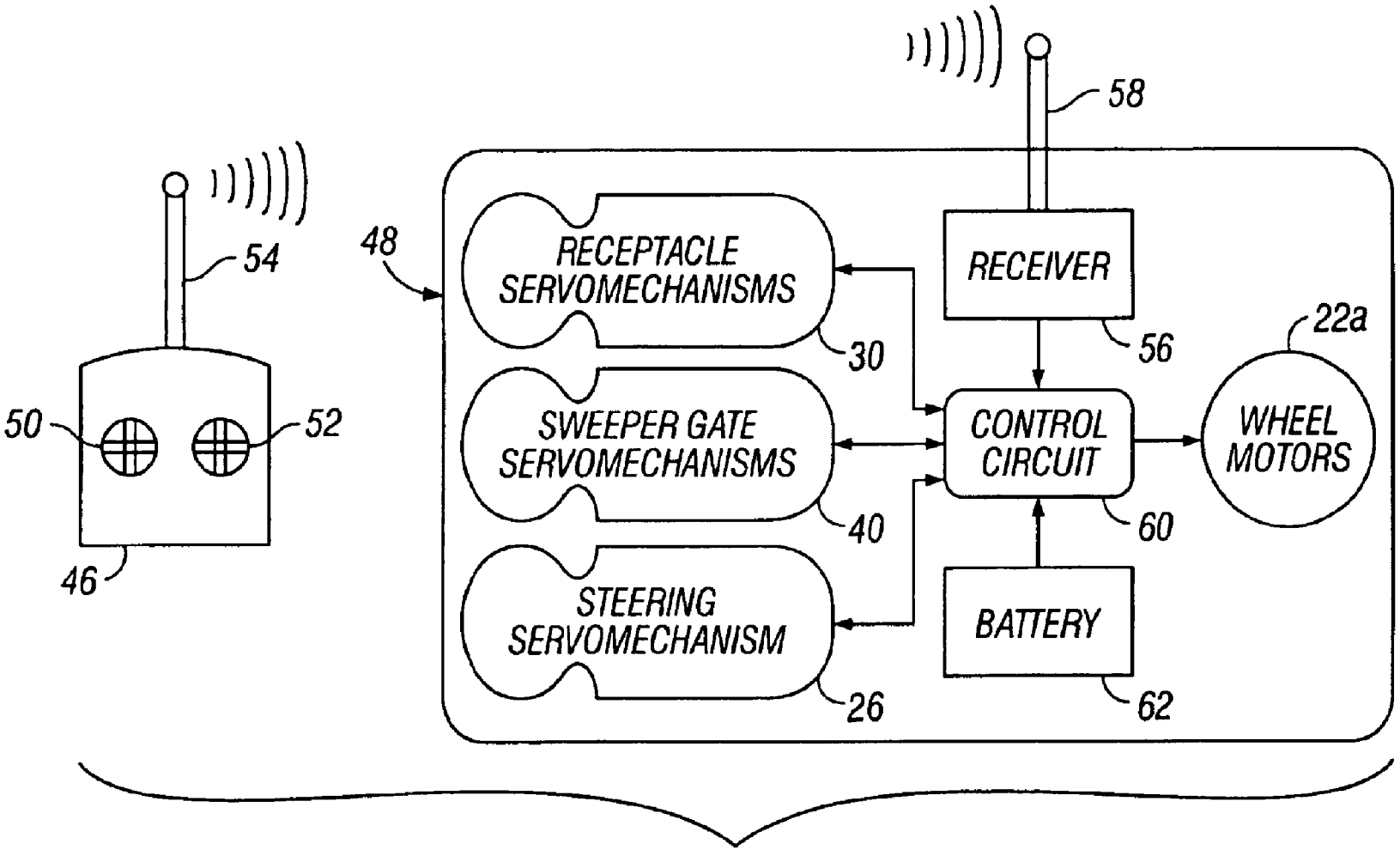
FIG. 4 illustrates a remote control and a block diagram of the onboard electrical components of the robotic system illustrated in FIGS. 1A and 1B.

FIG. 4 illustrates a hand-held wireless remote control 46 and a block diagram of the onboard electrical components 48 of the robotic system illustrated in FIGS. 1A and 1B. The remote control 46 allows an operator to remotely control the drive mechanisms onboard the vehicle 10. The remote control 46 is preferably a standard four channel radio frequency (RF) transmitter which is battery powered. This device has a pair of two-axis joy sticks 50 and 52 and an antenna 54. The electrical components 48 onboard the vehicle 10 include an RF receiver 56 coupled to another antenna 58 for receiving RF commands from the remote control 46. A control circuit 60 receives power from a battery 62. Based on RF commands received from the remote control 46, the control circuit 60 drives the wheel motors 22*a* of the electric motor and gear reduction assemblies 22 associated with each rearward wheel 18*a* to achieve precise forward, rearward and stop motion of the vehicle 10. The servomechanisms 26, 30 and 40 can be similarly controlled via the remote control 46 and control circuit 60 to steer the vehicle 10, lift and lower the receptacle 28 and open and close the sweeper gates 38, respectively. The servomechanisms are preferably the type that permit precise proportional control of these motions via operation of the joysticks 50 and 52.

In accordance with our invention a robotic method is also provided for collecting and dispensing regular and irregular shaped objects 12, 13 and 14. The first step of our method involves approaching the objects 12, 13 and 14 when they are spread over a support surface 20 with the forwardly opening receptacle 28 in its lowered collecting position. The next step of our method involves rotating the pair of sweeper gates 38 mounted on opposite ends of the receptacle 28 to entrap the objects 12, 13 and 14 and pull them into the receptacle 28 in one or more sweeping actions as the vehicle advances and when the objects are within a predetermined proximity of the receptacle 28. The next step of our method involves returning the receptacle 28 to the collection bin 36. In the preferred embodiment the vehicle 10 is backed up to the collection bin 36. The final step of our method involves elevating the receptacle 28 to its raised dumping position to dispense the collected objects 12, 13 and 14 into the collection bin 36.

While we have described preferred embodiments of our system and method for collecting and dispensing regular and irregular shaped objects, it will be apparent to those skilled in the art that our invention can be modified in both arrangement and detail. For example, a camera (not illustrated) can be mounted to the chassis 16 so that images can be communicated to the operator via a conventional RF communications link to facilitate remote operation of the vehicle 10. The remote control need not be an RF based communications link, but could be an infrared optical communications link or a hard wired link established through a wire or tethered cable. The drive means need not all be electro-motive devices. For example, the rearward wheels 18*1* could be powered by an internal combustion engine or a hydraulic engine. Therefore, the protection afforded our invention should only be limited in accordance with the scope of the following claims.

We claim:

1. A robotic system for collecting and dispensing regular and irregular shaped objects, comprising:

a chassis;

transport means for supporting the chassis for movement along a support surface over which are spread one or more regular or irregular shaped objects;

first drive means for powering the transport means;

a transversely extending, forwardly opening receptacle for receiving and holding the objects;

means for mounting the receptacle to the chassis for movement about a substantially horizontal axis between a lowered collecting position in front of the chassis and a raised dumping position for dispensing the objects into a collection bin behind the chassis;

second drive means for moving the receptacle between its lowered and raised positions;

a pair of sweeper gates;

means for pivotally mounting each sweeper gate at a corresponding end of the receptacle for pivotal motion about a corresponding vertical axis when the receptacle is in its lowered collecting position so that working together the pair of sweeper gates can rotate between fully open and fully closed positions to entrap and pull the objects into the receptacle when they are within a predetermined proximity of the receptacle;

third drive means for moving the sweeper gates between their fully open and fully closed positions; and means remote from the chassis for allowing an operator to control the first, second and third drive means.

2. The system of claim 1 wherein the transport means comprises a pair of forward wheels and a pair of rearward wheels.

3. The system of claim 2 and further comprising means for mounting the pair of rearward wheels for twisting motion to steer the chassis, and fourth drive means for twisting the rear wheels.

4. The system of claim 1 wherein the sweeper gates extend vertically to create a barrier for entrapping the objects.

5. The system of claim 4 wherein the sweeper gates have a dog-legged cross-section to facilitate entrapping the objects.

6. The system of claim 1 wherein the sweeper gates have a grid construction.

7. The system of claim 1 wherein the means for mounting the receptacle to the chassis includes a pair of elongate lifting arms and means for pivotally mounting a set of inner ends of the lifting arms to the chassis.

8. The system of claim 1 wherein the drive means are all electro-motive devices.

9. The system of claim 8 and further comprising a battery connected to the electromotive devices.

10. The system of claim 9 wherein the remote control means selectively connects the electromotive devices to the battery.

* * * * *